US005529251A

United States Patent [19]

Takami et al.

[11] Patent Number: 5,529,251

[45] Date of Patent: Jun. 25, 1996

[54] HEAT TREATMENT APPARATUS FOR CERAMICS

[75] Inventors: Masahiko Takami; Takahiro Yamamoto; Masami Yabuuchi; Hiroshi Seno; Masayoshi Katsube, all of Nagaokakyo, Japan

[73] Assignee: Murata Manufacturing Co., Ltd., Japan

[21] Appl. No.: 333,427

[22] Filed: Nov. 2, 1994

[30] Foreign Application Priority Data

Nov. 2, 1993 [JP] Japan ..... 5-274313

[51] Int. Cl.[6] ..... B02C 17/04; B02C 17/18

[52] U.S. Cl. ..... 241/65; 241/171; 241/177; 241/178; 241/179

[58] Field of Search ..... 241/66, 67, 170, 241/65, 171, 176, 177, 178, 179, 181

[56] References Cited

U.S. PATENT DOCUMENTS

| | | | |
|---|---|---|---|
| 634,254 | 10/1899 | Yates | 241/178 |
| 1,780,915 | 11/1930 | Hardinge | 241/179 |
| 2,098,054 | 11/1937 | McBerty | 241/66 X |
| 3,172,546 | 3/1965 | Schreiner | 241/179 X |
| 3,431,684 | 3/1969 | Ban | 241/179 X |
| 3,601,323 | 8/1971 | Giencke | 241/179 X |
| 4,048,465 | 7/1978 | Miller et al. | 241/179 X |
| 4,966,331 | 10/1990 | Maier et al. . | |

FOREIGN PATENT DOCUMENTS

| | | | |
|---|---|---|---|
| 643182 | 1/1979 | U.S.S.R. | 241/179 |
| 310495 | 2/1930 | United Kingdom . | |
| 923574 | 4/1963 | United Kingdom . | |
| 1110132 | 4/1968 | United Kingdom . | |
| 1486613 | 9/1977 | United Kingdom . | |

*Primary Examiner*—Timothy V. Eley
*Attorney, Agent, or Firm*—Ostrolenk, Faber, Gerb & Soffen

[57] ABSTRACT

A heat treatment apparatus for ceramics is adapted to heat treat a ceramic raw material such as a slurry for obtaining a pulverized ceramic material. The apparatus comprises a drum body (1) which is transversely supported and rotated about its axis, and a number of rolling media (2) which are stored and stirred in the drum body (1). The drum body (1) has a pyramidal inner surface, so that the rolling media (2) are strongly stirred following rotation of the drum body (1), whereby the ceramic raw material is heat treated and pulverized effectively.

15 Claims, 2 Drawing Sheets

HEAT TREATMENT APPARATUS FOR CERAMICS

BACKGROUND OF THE INVENTION

1. Field of the Invention

The present invention relates to a heat treatment apparatus for ceramics which carries out heat treatment such as drying or calcination on a ceramic raw material such as a green body or a slurry for obtaining a pulverulent ceramic material.

2. Description of the Background Art

In order to prepare a ceramic material for a piezoelectric ceramic resonator or the like, a plurality of types of ceramic materials are generally mixed with a solvent, and the mixed ceramic raw material, being a slurry, is introduced into a furnace such as a tunnel furnace or a rotary kiln such that the raw material is heat treated therein. Thereafter, the heat treated material is pulverized by a pulverizer such as a ball mill. However, since such a conventional method requires individual apparatus for heat treatment and pulverization, it has inferior working efficiency and cost performance.

SUMMARY OF THE INVENTION

Accordingly, an object of the present invention is to provide a heat treatment apparatus for ceramics which can heat treat and pulverize ceramic raw material simultaneously in a single drum body.

Another object of the present invention is to provide a heat treatment apparatus for ceramics which can pulverize ceramic material effectively without undesired aggregates, thereby obtaining a homogeneous ceramic material with stable characteristics.

Still another object of the present invention is to provide a heat treatment apparatus for ceramics which can continuously heat treat ceramic raw material.

A heat treatment apparatus according to the present invention comprises a drum body, driving means for rotating the drum body about its axis, heating means for heating the drum body and rolling media which are stored in the drum body. The drum body, whose axis is transversely supported, has a pyramidal inner surface. When a ceramic raw material which is a mixture of ceramic materials and a solvent is supplied into the drum body, therefore, the solvent contained in the ceramic raw material is quickly evaporated so that the ceramic materials adhere onto the rolling media. The rolling media roll and fall in the drum body in response to its rotation, thereby stirring and pulverizing the ceramic materials while performing heat treatment.

Since the drum body has a pyramidal inner surface, the rolling media are caught in valley portions which are defined on its inner surface, to be repeatedly raised up and dropped from high positions in response to rotation of the drum body. Thus, the media strongly collide with each other, whereby the ceramic material adhering onto the media is finely pulverized. Further, since the media which are collected in a lower portion of the drum body are raised up by the valley portions and circulated with those collected in an upper portion of the drum body, the ceramic material is uniformly stirred. Therefore, the ceramic material discharged from the drum body is homogeneously mixed in composition without undesired aggregates.

It is preferable for the drum body to have a first wall for closing a first end portion of the drum body, an inlet tube connected to a center of the first wall, and an outlet tube connected to a second portion of said drum body. In this case, the ceramic raw material is introduced into the drum body through the inlet tube and the heat treated material is discharged from the outlet tube. Also, the inlet and outlet tubes can serve as spindles of the drum body for its rotation.

Further, it is preferable to support the drum body in an inclined state so that the outlet tube is positioned lower than the inlet tube. In this case, when the ceramic raw material is supplied from the inlet tube, the solvent is evaporated in the heated drum body and then the ceramic material is finely pulverized. The pulverized ceramic material which is reduced in weight is raised up to a position above the media. Therefore, it is possible to continuously discharge only the pulverized ceramic material from the outlet tube.

When a raw material supply means for supplying the ceramic raw material is inserted in the inlet tube, it is possible to automate the supply of the ceramic raw material. When a material container for receiving the heat-treated and pulverized material is arranged under an outer end of the outlet tube, it is also possible to automate the collection of the ceramic material.

When the inlet and the outlet tubes are supported by a pair of rotatable rollers respectively and at least one of the rollers is driven by driving means such as an electric motor, it is possible to rotate the drum body by a simple structure.

When the drum body is arranged in an adiabatic housing having heating means therein, it is possible to obtain a safe heat treatment apparatus having high thermal efficiency.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

FIGS. 1 to 4 show a heat treatment apparatus according to a first embodiment of the present invention.

Figure 2:
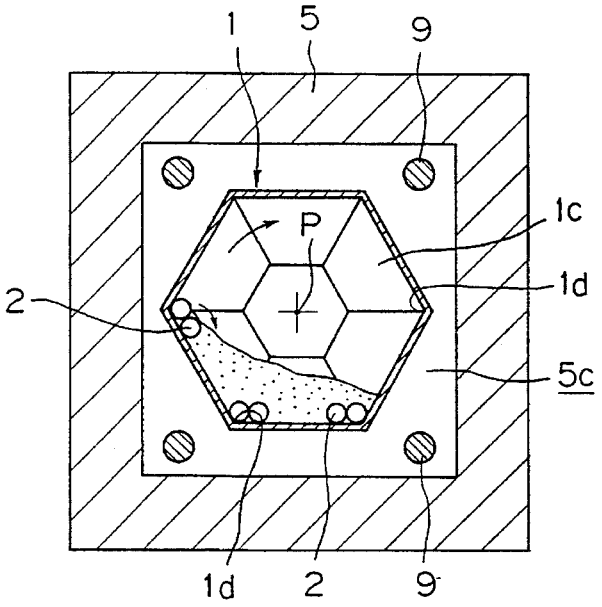
FIG. 2 is a sectional view taken along the line A—A in FIG. 1.
Figure 4:
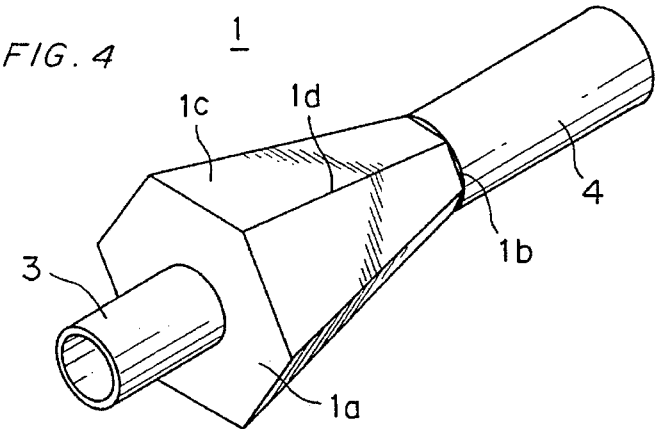
FIG. 4 is a perspective view showing the appearance of a drum body shown in FIG. 1.

This heat treatment apparatus comprises a pyramidal drum body 1 whose rotation axis P is transversely supported, and a number of rolling media 2 which are stored in this drum body 1 for being stirred in response to rotation of the drum body 1. According to this embodiment, the drum 1 has an equilateral hexagonal cross section as shown in FIG. 2, and is formed by heat-resistant material such as alumina ceramics, quartz or a heat-resistant metal plate. The drum 1 prepared for this embodiment may preferably be 300 mm in length from one end to the other 200 mm in diagonal length at the first end surface, and 90 mm in diagonal length at the second end. As shown in FIG. 4, cylindrical inlet and outlet tubes 3 and 4 positioned on the axis P of the drum 1 are connected to the center of the first end surface 1*a* and to the second end 1*b* of the drum 1 respectively. The interior and the exterior of the drum body 1 communicate with each other through the tubes 3 and 4. The axis P of the drum body 1 is supported in a state inclined at an angle θ of about 1° to 3°, so that the tube 4 is positioned slightly lower than the tube 3. Further, the tube 3 has a smaller inner diameter than that of the tube 4, thereby preventing the rolling media 2 and the ceramic raw material from overflowing into the tube 3.

Figure 1:
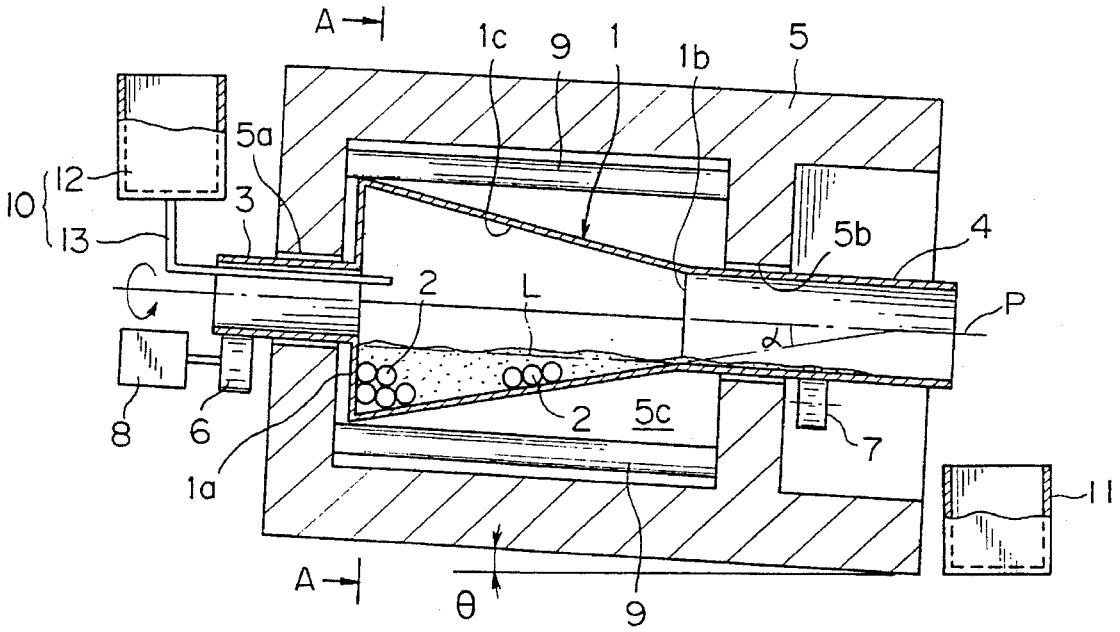
FIG. 1 is a longitudinal sectional view showing a heat treatment apparatus according to a first embodiment of the present invention.

The rolling media 2 are formed by spherical, columnar, prismatic or pyramidal substances of about 1 to 50 mm (preferably 20 to 30 mm) in diameter consisting of alumina ceramics, quartz or a heat-resistant metal, and serve as stirring media for stirring a ceramic raw material supplied into the drum 1, as thermal media for transferring heat to the ceramic raw material, and as pulverizing media for pulverizing the ceramic raw material. As shown in FIG. 1, the volume of the rolling media 2 stored in the drum 1 is preferably set to be lower than a level L which corresponds to the lower level of the tube 4, for example, so that the rolling media 2 will not overflow into the tubes 3 and 4 following rotation of the drum 1.

Since the drum body 1 has a pyramidal inner surface as described above, inclined walls 1*c* are connected with each other at an angle of 120° such that valley portions 1*d* are formed therebetween. These valley portions 1*d* can define grooves which are inclined at constant angles α with respect to the axis P in the interior of the drum body 1. The rolling media 2 which are stored in the drum body 1 are caught in the valley portions 1*d*, and then raised up following rotation of the drum body 1. When this pyramidal drum 1 is compared with a circular-conical drum, it has an advantage that the rolling media 2 are repeatedly raised up to higher positions as compared with those in the circular-conical drum, and then repeatedly dropped from the higher positions.

Figure 3:
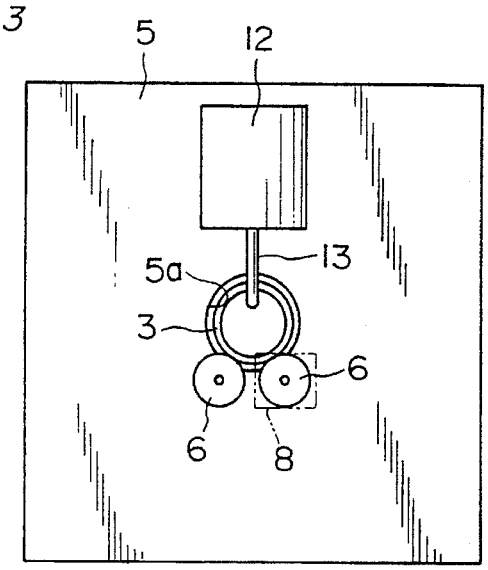
FIG. 3 is a side view of the heat treatment apparatus shown in FIG. 1.

The drum body 1 is arranged in a heating space 5*c* of an adiabatic housing 5. The tubes 3 and 4 outwardly project through holes 5*a* and 5*b* which are formed in both end portions of the housing 5. As shown in FIG. 3, the tube 3 projecting from the housing 5 is rotatably supported by a pair of rollers 6, and the tube 4 is rotatably supported by a pair of rollers 7. One of the rollers 6 is coupled to an electric motor 8, so that the drum 1 is rotated by the electric motor 8 through the roller 6 and the tube 3. Further, a plurality of (four in FIG. 2) heaters 9 are arranged in the heating space 5*c* of the housing 5 for heating the drum 1 up to a required temperature from the exterior.

The heaters 9 may alternatively have spiral shapes, in place of the linear shapes as shown in FIG. 1. These heaters 9 may be radiant heaters. Further, the heaters 9 are not restricted to those for heating the drum body 1 from its exterior, but the heaters 9 may be inserted in the drum 1 through the tube 3 or 4, to heat the drum 1 from inside. In addition, the heaters 9 may be direct fire type burner devices such gas burners. Further, induction heating or dielectric heating can also be employed, as a matter of course.

The heat treatment apparatus according to this embodiment further comprises raw material supply means 10 for supplying the slurry ceramic raw material into the drum body 1, and a material container 11 for containing the heat-treated ceramic material. The raw material supply means 10, which is arranged above a first end (left end in FIG. 1) of the housing 5 where the tube 3 is projecting outwardly, comprises a storage vessel 12 for storing a prepared ceramic raw material, and a raw material supply tube 13 which is introduced into the drum 1 through the tube 3. The material container 11, opening upwardly, is arranged under the opposite second end (right end in FIG. 1) of the housing 5 where the tube 4 is projecting outwardly so that the heat treated and pulverized ceramic material is discharged through the tube 4 and collected in this container 11.

A procedure for obtaining a pulverulent ceramic material through the heat treating apparatus according to this embodiment will now be described.

First, a ceramic raw material such as a green body or a slurry, which is a mixture of ceramic materials and a solvent, is prepared and stored in the vessel 12 of the raw material supply means 10. On the other hand, the drum body 1 storing the number of rolling media 2 is rotated by the electric motor 8 at a low speed of about 0.2 to 10 rpm. Then, the heaters 9 are energized to heat the drum 1 and the rolling media 2 up to a required temperature, for example, between 400° C. and 1200° C. Then, the ceramic raw material stored in the vessel 12 is supplied into the drum 1, which is already heated to the required temperature, little by little through the raw material supply tube 13.

When the raw material gets in contact with an inner wall of the drum body 1 or the media 2, the solvent contained in the ceramic raw material is quickly evaporated, whereby only ceramic material adheres onto surfaces of the media 2. Since the media 2 are stirred following rotation of the drum 1, the ceramic material adhering to the surfaces thereof is finely pulverized due to collision and rubbing among the media 2. In particular, the media 2 which are caught in the valley portions 1*d* defined in the interior of the drum 1 are repeatedly raised up and dropped from high positions following the rotation of the drum 1, whereby the media 2 strongly collide with each other to finely pulverize the ceramic material remaining thereon.

Since the ceramic material heat-treated and finely pulverized is reduced in weight, it raised up to a position above the media 2 being stirred. Thus, the heat-treated and pulverized ceramic material is outwardly discharged from the tube 4, and collected in the container 11. At this time, while the heat-treated material is guided through the tube 4, the material is gradually air-cooled.

Since the ceramic raw material newly supplied from the supply means 10 has heavy weight due to the solvent, it enters a position under the media 2. Thus, the newly supplied ceramic raw material is not discharged from the tube 4 as it is. The ceramic raw material newly supplied into the drum 1 is repeatedly subjected to evaporation of the solvent, heat-treatment and pulverization of ceramic material. It is possible to freely control the storage time required from introducing the ceramic raw material into the drum 1 to discharging the ceramic material, by adjusting the angle θ of inclination and the speed of rotation of the drum 1.

The shape of the drum body 1 is selected in consideration of characteristics of the ceramic raw material upon heat treatment, such as adhesion and aggregation. When the ceramic raw material has strong cohesive force, it is preferable to prepare the drum 1 in a shape such as a square pyramid having small opening angles at the valley portions 1*d*. On the contrary, when the ceramic raw material is easy to dry and mass treatment is required, it is effective to to prepare the drum 1 in a polygonal pyramidal shape having many corners.

Figure 5:
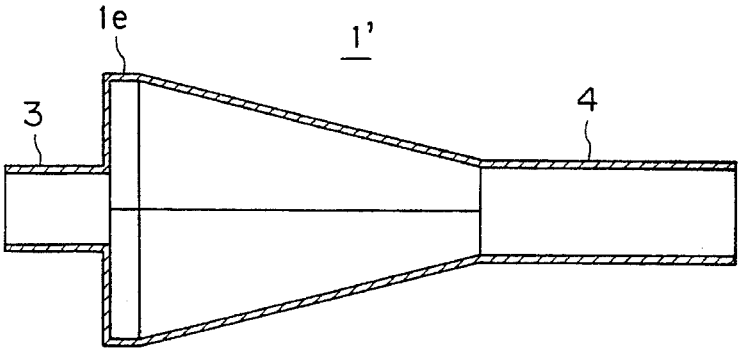
FIG. 5 is a longitudinal sectional view showing a drum body according to a second embodiment of the present invention.

As shown in FIG. 5, it is possible to change the shape of the drum body 1' by connecting a prismatic portion 1*e* to the bottom end of the drum 1'. In this case, the drum body 1' can increase its capacity and decrease residue and solidification of the material at its bottom corners.

Moreover, it is also possible to form at the bottom corners of the drum 1 curved surfaces whose radius of curvature are larger than those of the rolling media 2.

The axis of the drum 1 of the above described embodiment is slightly inclined in order to automatically discharge the heat-treated ceramic material. However, it is also possible to discharge the heat-treated material automatically by only setting the diameter of the outlet tube 4 shorter than that of the inlet tube 3.

The first wall la of the drum 1 may be closed and the raw material supplying tube 13 may be inserted into the drum 1 through the tube 4. In this case, both the introduction of the untreated material and discharge of the treated material are performed through tube 4.

Further, both of the tubes 3 and 4 may be closed, and, for example, insert gas may be charged into the drum 1 so as to heat treat the raw material without oxidation.

Although the heat-treated material is collected in the container 11 in the above described embodiment, another apparatus such as a rotary kiln may be installed at the end of the outlet tube 4, so that the heat-treated and pulverized material is successively supplied to the next step.

The ceramic raw material is not restricted to a slurry material. Semi-solid or solid materials such as a green body may also be used as raw materials.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat treatment apparatus for ceramics for heat treating and pulverizing a ceramic raw material, said heat treatment apparatus comprising:

a drum body having a pyramidal inner surface to be supplied with sid ceramic raw material therein, sid drum body having an axis transversely supported and being rotatable about said axis;

driving means for rotating said drum body about said axis;

heating means for heating said drum body; and rolling media stored in said drum body for being stirred in response to rotation of said drum body in order to pulverize said ceramic raw material;

wherein said drum body comprises:

a first wall for closing a first end portion of said drum body corresponding to a wider portion of said pyramidal inner surface; and a tube connected to a second portion of said drum body for introducing said ceramic raw material into said drum body and for discharging heat treated ceramic material from said drum body.

2. A heat treatment apparatus for ceramics for heat treating and pulverizing a ceramic raw material, said heat treatment apparatus comprising:

a drum body having a pyramidal inner surface to be supplied with said ceramic raw material therein, said drum body having an axis transversely supported and being rotatable about said axis;

driving means for rotating said drum body about said axis;

heating means for heating said drum body; and rolling media stored in said drum body for being stirred in response to rotation of said drum body in order to pulverize said ceramic raw material;

wherein said drum body comprises:

a first wall for closing a first end portion of said drum body corresponding to a wider portion of said pyramidal inner surface;

an inlet tube connected to a center of said first wall for introducing said ceramic raw material into said drum body; and an outlet tube connected to a second portion of said drum body for discharging heat treated ceramic material from said drum body;

wherein a bore diameter of said outlet tube is larger than that of said inlet tube for permitting heat-treated and pulverized ceramic material to overflow from said drum body into said outlet tube.

3. A heat treatment apparatus for ceramics in accordance with claim 2, wherein a raw material supply means for supplying said ceramic raw material is inserted in said inlet tube.

4. A heat treatment apparatus for ceramics in accordance with claim 2, wherein a container for receiving said heat treated ceramic material is arranged under an outer end of said outlet tube.

5. A heat treatment apparatus for ceramics in accordance with claim 2, wherein said inlet tube and said outlet tube are rotatably supported by a plurality of rollers respectively, at least one of said rollers is driven by said drive means.

6. A heat treatment apparatus for ceramics in accordance with claim 2, wherein said drum body is arranged in an adiabatic housing having said heating means therein.

7. A heat treatment apparatus for ceramics in accordance with claim 2, wherein said drum body has a substantially hexagonal pyramidal inner surface.

8. A heat treatment apparatus for ceramics in accordance with claim 2, wherein said drum body comprises:

a first wall for closing a first end portion of said drum body; and a tube connected to a second portion of said drum body for introducing said ceramic raw material into said drum body and for discharging heat treated ceramic material from said drum body.

9. A heat treatment apparatus for ceramics for heat treating and pulverizing a ceramic raw material, said heat treatment apparatus comprising:

a drum body having a pyramidal inner surface to be supplied with said ceramic raw material therein, said drum body having an axis transversely supported and being rotatable about said axis;

driving means for rotating said drum body about said axis;

heating means for heating said drum body; and rolling media stored in said drum body for being stirred in response to rotation of said drum body;

wherein said drum body comprises:

a first wall for closing a first end portion of said drum body corresponding to a wider portion of said pyramidal inner surface;

an inlet tube connected to a center of said first wall for introducing said ceramic raw material into said drum body; and an outlet tube connected to a second portion of said drum body for discharging heat treated ceramic material from said drum body;

wherein said drum body is supported in an inclined state so that said outlet tube is positioned lower than said inlet tube for permitting heat-treated and pulverized ceramic material to overflow from said drum body into said outlet tube.

10. A heat treatment apparatus for ceramics in accordance with claim 9, wherein a raw material supply means for supplying said ceramic raw material is inserted in said inlet tube.

11. A heat treatment apparatus for ceramics in accordance with claim 9, wherein a container for receiving said heat treated ceramic material is arranged under an outer end of said outlet tube.

12. A heat treatment apparatus for ceramics in accordance with claim 9, wherein said inlet tube and said outlet tube are rotatably supported by a plurality of rollers respectively, at least one of said rollers is driven by said drive means.

13. A heat treatment apparatus for ceramics in accordance with claim 9, wherein said drum body is arranged in an adiabatic housing having said heating means therein.

14. A heat treatment apparatus for ceramics in accordance with claim 9, wherein said drum body has a substantially hexagonal pyramidal inner surface.

15. A heat treatment apparatus for ceramics in accordance with claim 9, wherein said drum body comprises:

a first wall for closing a first end portion of said drum body; and a tube connected to a second portion of said drum body for introducing said ceramic raw material into said drum body and for discharging heat treated ceramic material from said drum body.

* * * * *